US006402613B1

(12) United States Patent
Teagle

(10) Patent No.: US 6,402,613 B1
(45) Date of Patent: Jun. 11, 2002

(54) PORTABLE ENVIRONMENTAL CONTROL SYSTEM

(76) Inventor: David B. Teagle, 403 W. Cherry St., Kaufman, TX (US) 75142

( * ) Notice: Subject to any disclaimer, the term of this patent is extended or adjusted under 35 U.S.C. 154(b) by 0 days.

(21) Appl. No.: 09/790,178

(22) Filed: Feb. 21, 2001

(51) Int. Cl.[7] ..... F24F 7/013

(52) U.S. Cl. ..... 454/195; 55/356; 55/473; 55/485; 454/341; 454/357; 454/903

(58) Field of Search ..... 454/195, 200, 454/207, 341, 345, 357, 903; 55/342, 356, 467, 473, 482, 485

(56) References Cited

U.S. PATENT DOCUMENTS

| | | | | |
|---|---|---|---|---|
| 667,149 A | * | 1/1901 | Kenney | 126/271.2 A |
| 2,348,455 A | * | 5/1944 | Daudelin | 454/200 |
| 2,747,201 A | * | 5/1956 | Herriott | 4/213 |
| 4,163,650 A | | 8/1979 | Watson et al. | |
| 4,446,861 A | | 5/1984 | Tada | |
| 4,512,245 A | | 4/1985 | Goldman | |
| 4,905,578 A | * | 3/1990 | Curtis et al. | 454/229 |
| 4,932,988 A | | 6/1990 | Lutterbach et al. | |
| 5,004,483 A | * | 4/1991 | Eller et al. | 134/111 |
| 5,069,691 A | | 12/1991 | Travis et al. | |
| 5,139,546 A | | 8/1992 | Novobilski | |
| 5,230,723 A | | 7/1993 | Travis et al. | |
| 5,281,246 A | | 1/1994 | Ray et al. | |
| 5,312,465 A | | 5/1994 | Riutta | |
| 5,417,729 A | | 5/1995 | Greenleaf, Sr. | |
| 5,433,763 A | | 7/1995 | Shagott et al. | |
| 5,588,985 A | | 12/1996 | Shagott et al. | |
| 5,702,493 A | | 12/1997 | Everetts et al. | |
| 5,853,441 A | | 12/1998 | Green et al. | |
| 5,873,919 A | | 2/1999 | Vross et al. | |

FOREIGN PATENT DOCUMENTS

FR 2 675 717 * 10/1992

* cited by examiner

*Primary Examiner*—Harold Joyce
(74) *Attorney, Agent, or Firm*—Randall C. Brown; Haynes and Boone, L.L.P.

(57) ABSTRACT

A portable environmental control system for evacuating particulate laden, toxic, and explosive gasses from an interior space includes a flexible partition for erection at the interior space, and a first section of flexible duct connected to the partition and to an electric motor driven blower unit having an explosion proof ducted fan. A second section of duct is connected to the blower unit and may be connected to a filter unit mountable in a window of an interior room or to a collapsible plenum having plural filter units mounted therein for treating and returning air evacuated from the space back into the space. The blower unit may be placed within a space having a high concentration of explosive gasses for evacuating the gasses by way of an elongated duct section connected to an elevating mechanism to discharge gasses out of doors above ground level.

25 Claims, 7 Drawing Sheets

PORTABLE ENVIRONMENTAL CONTROL SYSTEM

FIELD OF THE INVENTION

The present invention pertains to a portable environmental control system including a motor driven fan or blower, a flexible duct system and air filtration units for removing toxic and/or explosive gasses from building interior rooms and other confined spaces.

BACKGROUND OF THE INVENTION

There are many situations wherein volatile, toxic and particulate laden gasses are generated or leak into an interior room of a building or other confined space. The presence of explosive gasses, such as vapors from hydrocarbon based products, as well as natural or liquefied petroleum gasses, often occur within an enclosure or confined space, such as an interior room of a building, a storage tank or the cargo hold of a ship, for example. In many instances, the generation of toxic or explosive gasses may occur in spaces which are somewhat inaccessible, such as the upper floors of a multistory building, the cargo hold of a ship, as well as many other confined spaces from which such gasses and vapors need to be safely evacuated. Volatile organic compounds such as automobile and aircraft paints, resurfacing materials, porcelain paints, reducers, glues, cleaning agents, grain dust and hydrocarbon fumes must be carefully evacuated from an interior space to avoid adverse effects, including unwanted combustion of such materials. In many instances, such materials cannot be safely or conveniently vented to atmosphere and treatment of such gaseous material may be required to occur within the interior space being evacuated of such material or a confined space generally adjacent to the space being evacuated.

In pursuing the development of the present invention, applicant has noted the dearth of portable equipment suitable for handling explosive or toxic gasses or vapors, including equipment which is essentially explosion proof and may be quickly and conveniently set up adjacent to or even placed within a confined space from which the toxic or explosive materials are to be evacuated. Commercially available motor driven blowers or fans, for example, typically are directly connected to an electric drive motor or a combustion engine. Such equipment cannot be safely placed in the confines of a space from which the aforementioned materials require evacuation. Moreover, direct connected motors tend to become severely clogged with particulate material entrained in the gases being evacuated Another problem associated with prior art equipment for treating or evacuating volatile or toxic gasses is, as mentioned above, the lack of portability of such equipment. For example, in high rise commercial or residential buildings it is often necessary to carry out processes in performing construction work or applying finishing or refinishing materials in interior rooms, which processes and materials generate substantial amounts of toxic and/or explosive fumes. Such materials include paints and adhesives, for example. These materials cannot be evacuated directly to atmosphere either as a consequence of environmental regulations or because of the construction of the structure from which the material is to be removed. Accordingly, there has been a long-felt need to develop portable equipment which may be taken into generally inaccessible, confined interior spaces within a building or vessel, for example, and erected for evacuating gasses from such spaces without discharging the evacuated gasses untreated into an adjacent confined space and without discharging such materials untreated directly to atmosphere exterior of the structure being evacuated.

Although certain types of filters such as so-called HEPA filters are available for certain types of ventilation systems, the volumetric flow rate capacity of such filters is relatively low and such filters cannot, typically, be used in applications wherein a high volumetric flow rate of toxic gas laden air must be treated and treated rapidly. Accordingly, prior art fume or gas evacuation type environmental control systems are not suitable for hazardous or explosive environments, are not actually portable and cannot be easily moved by personnel who may be required to take action in performing a number of functions quickly in a hazardous situation, such personnel including firemen or utility technicians, for example. Portability is also a major concern with regard to the provision of environmental control systems of the general type associated with the present invention because of the short time frame available to set up and operate the equipment in areas wherein high concentrations of toxic or explosive gasses may be present.

Accordingly, there has been an acute need to develop a more efficient and less hazardous system for handling various types of toxic and explosive gasses and vapors, particularly with regard to interior spaces which may, in many instances, be somewhat inaccessible. It is to these ends that the present invention has been developed.

BRIEF SUMMARY OF THE INVENTION

The present invention provides an improved portable environmental control system, particularly adapted for evacuating volatile, toxic, particulate laden or otherwise potentially explosive gasses and vapors from an interior room or confined space within a building or other structure.

In accordance with one aspect of the present invention a portable environmental control system is provided which is adapted to evacuate toxic or explosive gasses or vapors from a confined space while minimizing the chance of ignition or combustion of the vapors or gasses being handled by the system. The portable environmental control system contemplates the provision of one or more sections of elongated flexible duct adapted to be connected to an indirect drive type motor driven fan or blower unit, which is rated by regulatory authorities for hazardous conditions, for conducting vapors from an interior space to a portable filtration unit or directly vented to atmosphere, when permissible or necessary in emergency situations.

A portable blower unit in accordance with the invention preferably utilizes an axial flow electric motor driven fan which includes drive mechanism and a location of the electric motor on the blower unit which is isolated from gasses or vapors being handled by the system so as to minimize an unwanted source of ignition. The portable blower unit is also adapted to utilize conventional household electric power sources or higher voltage electric power sources by providing connections to the blower unit for each of the sources via elongated power cords. The power cords are configured to minimize the chance of generating a source of ignition for volatile gasses or vapors being handled by the system, are enclosed in a flame and abrasion resistant sleeve and are preferably fire resistant rated by authorities, such as Underwriters Laboratories, Inc. (UL)

In accordance with another aspect of the present invention a portable environmental control system is provided for evacuating and treating various gaseous materials whereby air which entrains the gaseous materials may be returned to the general vicinity of the interior space from which the gasses or vapors are evacuated. In this way the system of the invention may be disposed in the confines of a space being treated or disposed in an enclosed space directly adjacent to a space being treated without discharging unwanted gasses or vapors into other parts of a building or other structure. The system includes a portable plenum and one or more gas filtration units which may be easily transported to or from, erected or assembled and collapsed or disassembled within a confined space, such as an interior room of a high-rise building or the like, or a cargo hold of a ship or a cabin or cargo hold of an aircraft, for example.

In accordance with still a further aspect of the invention a compact multi-stage filter cabinet is provided which may be adapted for use with a large plenum or filter unit or may also be positioned in a window or other opening for venting treated air directly to atmosphere from an interior or confined space which is being evacuated of toxic or explosive vapors or gasses.

Still further, the invention provides a high volumetric capacity, lightweight, portable environmental control system which may be easily transported to the site of an interior room or space from which gaseous materials are to be evacuated at a high volumetric flow rate and utilizing conventional low or intermediate voltage electric power sources. The environmental control system of the present invention may be easily used in interior rooms of a high density dwelling unit structure, such as a hotel or apartment complex or within dangerous, confined spaces such as a storage tank, the cargo hold or space of a ship, other surface transportation vehicles or aircraft.

Those skilled in the art will further appreciate the above-noted advantages and superior features of the invention together with other important aspects thereof upon reading the detailed description which follows in conjunction with the drawings.

BRIEF DESCRIPTION OF THE SEVERAL VIEWS OF THE DRAWINGS

FIG. 7 is a perspective view illustrating an application of the environmental control system of the present invention for evacuating explosive gasses from an interior room of a residential apartment complex or the like;

DETAILED DESCRIPTION OF THE INVENTION

Figure 1:
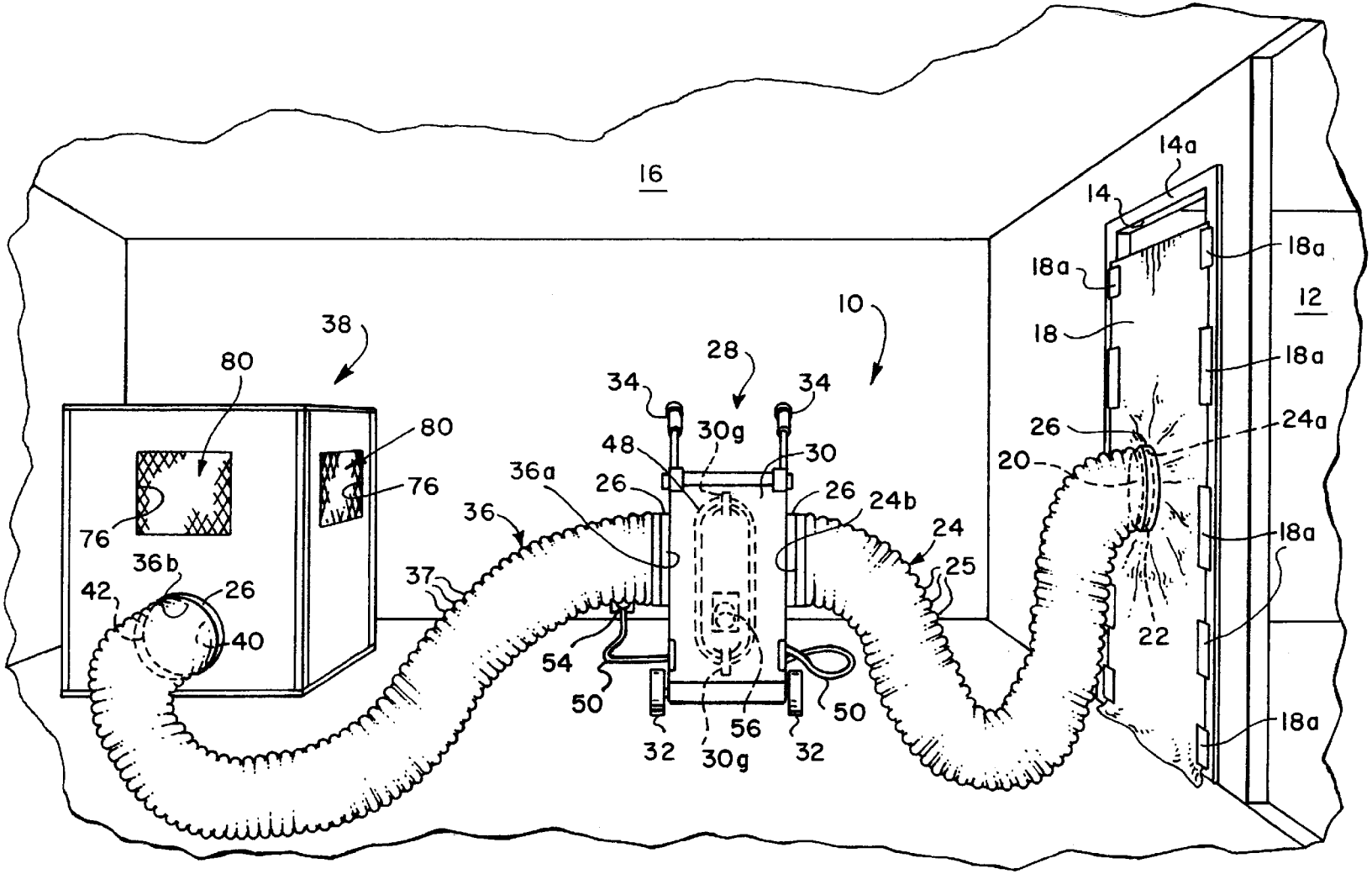
FIG. 1 is a perspective view of one preferred embodiment of a portable environmental control system of the present invention in an application to evacuate volatile organic compounds (VOCs) in gaseous form from an interior room of a building.

In the description which follows, like parts are marked throughout the specification and drawing with the same reference numerals, respectively. The drawing figures may not necessarily be to scale in the interest of clarity and conciseness. Conventional or commercially available elements may be shown in generalized form, also in the interest of clarity and conciseness.

Referring to FIG. 1, there is illustrated a portable environmental control system in accordance with the invention and generally designated by the numeral 10. The environmental control system 10 is particularly adapted for evacuating toxic or volatile vapors or particulate laden air from a confined space, such as an interior room 12 of a building and having a doorway 14 opening into another confined space, such as an interior room 16. For example, the room 12 may be a bathroom or kitchen of an apartment in a high-rise building or a hotel. During construction or remodeling, certain paints, adhesives or similar compositions may be used in such quantity within the room 12 as to generate an unacceptable concentration of volatile organic compounds (VOCs), toxic fumes, explosive gasses, or particulate laden air which must be evacuated from the room 12 and treated or discharged to atmosphere. In many instances discharging volatile, toxic or other explosive gasses, such as natural gas, directly to atmosphere is not acceptable, except in extreme emergency situations. The environmental control system 10 includes a flexible partition member comprising curtain-like cover 18 which may be formed of heavy gauge plastic sheet such as polyvinylchloride. The partition member or cover 18 may be erected to delimit the space or room 12 by substantially covering the doorway 14 and be secured to the door jamb or frame 14*a* by suitable fasteners, such as adhesive tape strips 18*a*. The curtain-like cover 18 includes a suitable port 20 formed therein of relatively large diameter, preferably about twelve to fourteen inches, and defined by a circular flange 22. An elongated, flexible, cylindrical duct section 24 is connected to the flange 22 by a suitable cylindrical collar or cuff 26 of a type commercially available for quickly and releasably connecting one end 24*a* of the duct section to the flange 22. The duct section 24 is preferably formed of a somewhat chemically resistant material, such as Neoprene, or a flame retardant polyester impregnated canvas, and preferably includes an encapsulated wire-like helical coil, not shown, to maintain the duct section in a generally cylindrical uncollapsed state. Moreover, the aforementioned wire coil also provides for corrugations 25 which allow the duct section 24 to be substantially flexible and bendable without collapsing. The opposite end 24*b* of the duct section 24 is connected to a hazardous conditions (UL) rated portable electric motor-driven blower unit, generally designated by the numeral 28. Blower unit 28 includes a generally rectangular, lightweight, aluminum or plastic cabinet 30 supported on spaced apart wheels 32 and suitably connected to manipulating handles 34 for moving the blower unit 28, at will.

Blower unit 28 is connected to a second elongated flexible duct section 36 constructed substantially similar to the duct section 24 and including suitable corrugations 37 also formed by a wire coil encapsulated within the plastic hose-like structure of the duct section 36. Duct sections 24 and 36 are of about twelve inches to fourteen inches diameter for a system 10 having a volumetric flow rate of about 1,600 cubic feet per minute (CFM) without a filter unit or 1,000 CFM with a filter. One end of the duct section 36, designated by numeral 36*a*, is connected to blower unit 28 by a collar or cuff 26 and the opposite end, in one preferred application of the environmental control system 10, is connected to a plenum 38. Plenum 38 is provided with a suitable port 40 delimited by a cylindrical flange 42 for receiving end 36*b* of duct 36 secured thereto by a suitable collar 26. The plenum 38 is adapted to support multiple filter units therewithin as will be described in further detail herein in conjunction with FIGS. 4, 5 and 6 of the drawings.

Figure 2:
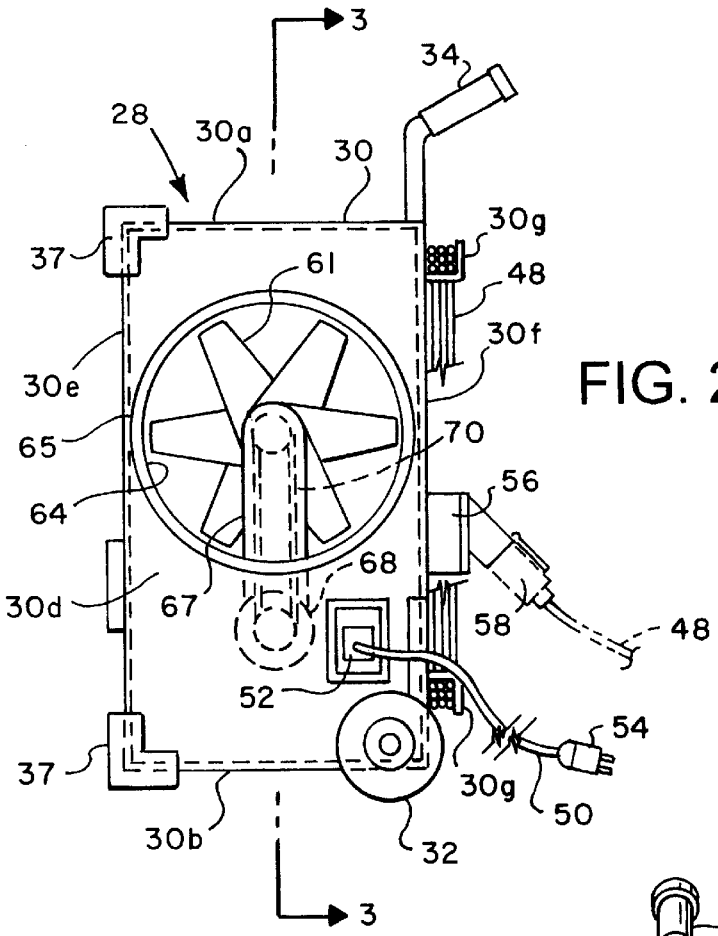
FIG. 2 is a side elevation of a portable electric motor driven blower unit for the environmental control system of the present invention.
Figure 3:
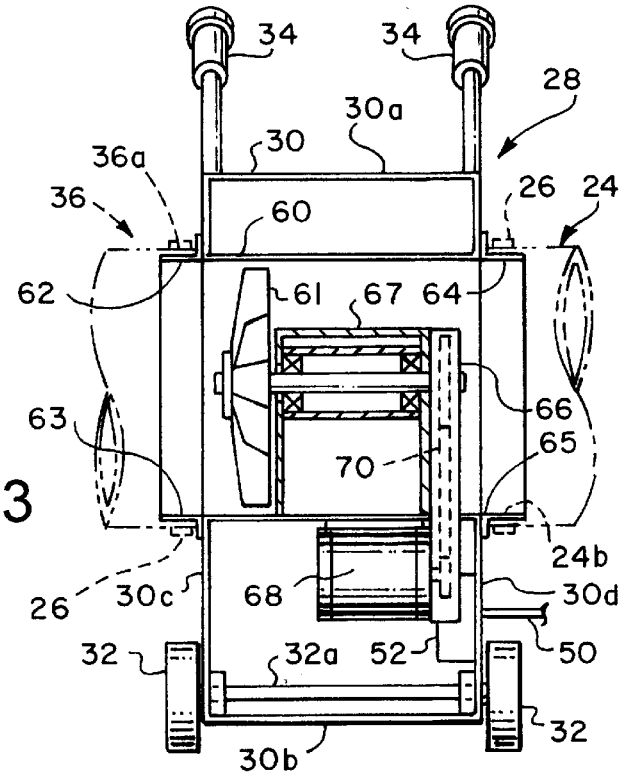
FIG. 3 is a section view taken generally from the line 3—3 of FIG. 2.

Referring now to FIGS. 2 and 3, the blower unit 28 is shown in further detail. As described previously, the cabinet or housing 30 is characterized by a generally rectangular lightweight metal box, preferably fabricated of a spark resistant material, such as a suitable reinforced plastic or aluminum, and includes a top wall 30*a*, a bottom wall 30*b*, opposed side walls 30*c* and 30*d*, a front wall 30*e* and a rear wall 30*f*. Wheels 32 are supported by a suitable axle 32*a*, FIG. 3, extending between the side walls 30*c* and 30*d* and supported on suitable bearings, not shown in detail. Wheels 32 overlap or extend beyond rear wall 30*f* and are formed of a suitable elastomer material. The intersections of top wall 30*a* and bottom wall 30*b* with the side walls and front and rear walls are at least partially covered by Neoprene or other elastomer caps or bumper members 37 to form protection to avoid damage to building interior walls and furnishings and to also minimize the chance of any source of ignition being generated, in a collision of the blower unit with other structure, such as might occur from a friction spark or the like. Back wall 30*f* includes spaced apart brackets 30*g* for supporting electrical conductor means comprising a lengthy heavy-duty power cord 48. Power cord 48 may be an eight gauge or a ten gauge cord of about one hundred feet to two hundred feet in length and is preferably an SO designated cord, hazardous conditions rated, disposed within a flame resistant sleeve or cover, such as Gorilla rubber from Goodyear Corporation. A second electrical conductor means comprises a power cord 50 which is connected to a suitable explosion proof fitting 52 in cabinet side wall 30*d*. Cord 50 includes a conventional three-pronged plug 54 for connection to a conventional one hundred twenty volt AC electric power source, such as commonly found in most households, office buildings, hotels and other commercial buildings.

Alternatively, the power cord 48 may be used to provide power to the motor driven blower unit 28 if the source of electrical power is 220 to 240 volts AC, for example. In this regard, an explosion-proof junction box 56 is suitably mounted on cabinet back wall 30*f* and is operable to receive a plug 58 connected to power cord 48. Junction box 56 and its associated receptacle and plug 58 may be of a type commercially available such as one of a U-LINE brand sealed receptacles and plugs available from Appleton Electric Company, Chicago, Ill. Accordingly, sources of electric power for the blower unit 28 may be conventional 110–120 volt AC sources providing power to the blower unit via the power cord 50, which also may be of substantial length and stored along with the cord 48 on the housing or cabinet back wall 30*f*. Alternatively, power cord 48 may be connected to a suitable source of 220–240 volt AC electric power via the plug 58 and junction box 56.

Referring further to FIGS. 2 and 3, the blower unit 28 includes a rigid transverse duct 60 extending between side walls 30*c* and 30*d* and preferably formed of aluminum or reinforced plastic. Duct 60 is substantially cylindrical and is coaxial with ports 62 and 64, FIG. 3, which are defined by cylindrical flanges 63 and 65 for receiving the ends 36*a* and 24*b* of the respective flexible duct sections 36 and 24. The duct sections 24 and 36 are secured to the respective flanges 65 and 63 by collars 26, respectively, FIG. 3. Referring further to FIGS. 2 and 3, a multiblade axial flow fan 61 is disposed within the duct 60 and supported on suitable bearings disposed within a housing 67. An encased drive mechanism, such as an endless belt drive 70, is disposed within an enclosure or case 66 so that air and gasses flowing through the duct 60 are isolated from any part of the blower unit 28 except the interior of the duct. A suitable AC electric drive motor 68 is mounted within the cabinet 30 and is drivably connected to the fan 62 by belt drive 70 disposed within the housing 66, as shown in FIGS. 2 and 3.

Motor 68 is operated via a suitable control circuit, not shown, to receive electrical power by the power cord 50 or the power cord 48 for operation at either 110–120 volts AC or 220–240 volts AC, as the case may be. The fan 61, the associated duct 60 and the motor 68 may be of a type commercially available, such as from Dayton Electric Manufacturing Company as one of their TUBEAXIAL brand axial flow fan units. Thanks to the construction of the duct 60, the fan 61, the housing 67, the drive mechanism 70 and its encapsulating housing 66 volatile or explosive gasses being pumped by the fan are not exposed to a source of ignition when flowing through the blower unit 28. Moreover, by constructing the housing or cabinet 30 from aluminum plate or suitable reinforced plastic, for example, and by providing suitable bumper members 37, for example, as well as the other configuration features of the blower unit 28, the blower unit may located in the environment of explosive concentrations of vapors or gasses, including natural gas, and may be operated to evacuate such vapors or gasses without risk of the blower unit being a source of ignition for such vapors or gasses. The collars 26 may be of a type commercially available such as a flexible belt which may be cinched around the flanges of the curtain or cover 14, the blower unit 28 and the plenum 38. The duct sections 24 and 36 may be of various lengths and may comprise plural interconnected sections of manageable length for portability and transport. In this regard flat band/nylon ring type connectors, not shown, may be employed between plural end-to-end connected duct parts to make up the duct sections 24 and 36.

Figure 4:
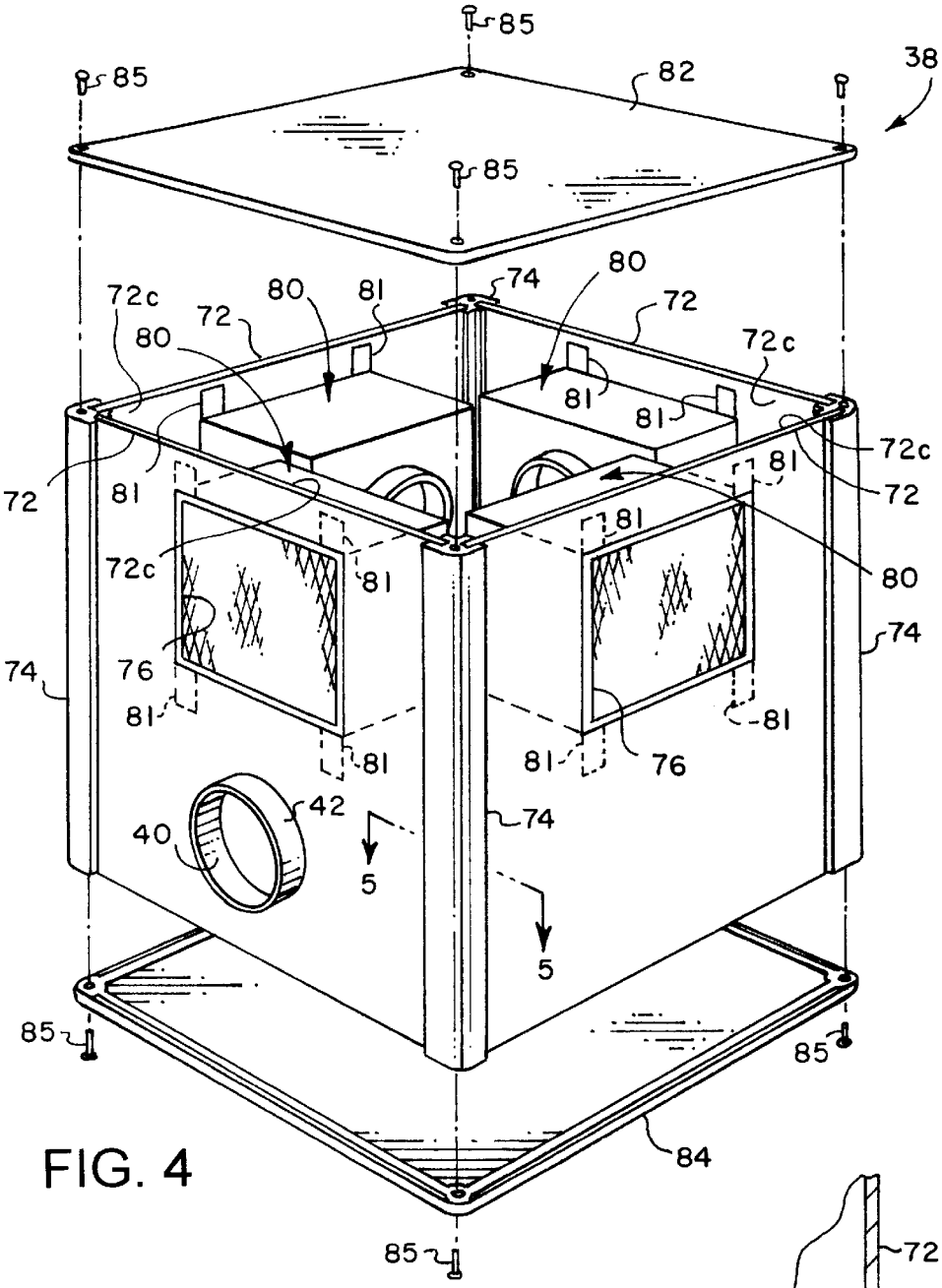
FIG. 4 is an exploded perspective view of a portable plenum and filter unit for the system of the present invention.
Figure 5:
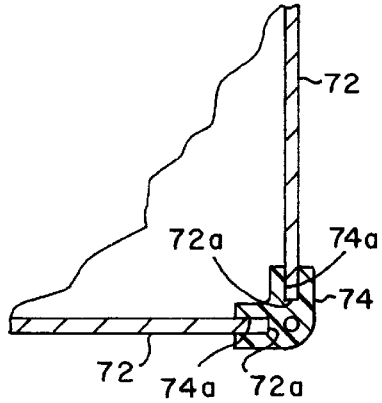
FIG. 5 is a detail section view taken from the line 5—5 of FIG. 4.

Referring now to FIGS. 4 and 5, one embodiment of a plenum in accordance with the invention is illustrated in some detail and comprises the plenum 38 previously described and shown in FIG. 1. The plenum 38 is preferably a rigid rectangular box of about five feet to six feet square and is characterized by four lightweight, rigid, aluminum or reinforced plastic side wall panels 72 which are interconnected by extruded corner connector parts 74, see FIG. 5. The edges 72*a*, FIG. 5, of the panel 72 may be a slight force fit in cooperating slots 74*a* formed in the corner parts 74, as shown in FIG. 5. Each of the panels 72 includes a generally rectangular opening 76 formed therein adjacent which are mounted, respectively, removable rectangular box-like filter units 80. At least one of the panels 72 is provided with the port 40 defined by the cylindrical flange 42. Removable, rigid, aluminum or plastic, flat plate top and bottom walls 82 and 84 may be joined to the assembly of the four panels or side walls 72 and the corner parts 74 by suitable fasteners 85 to form the assembled plenum 38, as shown in FIG. 1. Accordingly, the filter units 80 may be mounted on the interior sides 72*c* of the panels 72 by suitable fastening means, such as hook and loop fastener strips 81, for example. Accordingly, the portability of the system 10 is further enhanced by the provision of the collapsible plenum 38 and the plural filter units 80 which may be mounted on the interior of the plenum when it is assembled.

Figure 8:
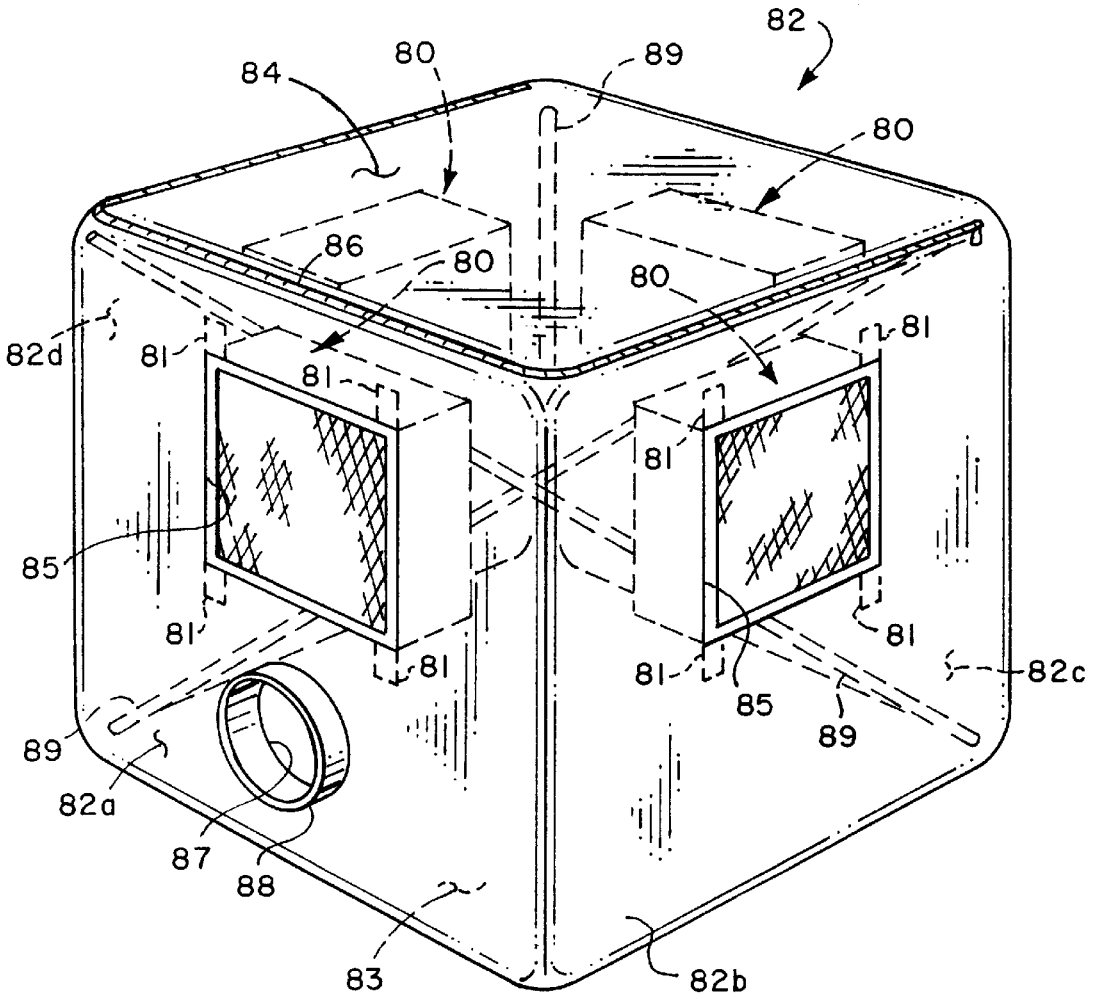
FIG. 8 is a perspective view of one alternate embodiment of a plenum and filter unit in accordance with the invention.

Referring briefly to FIG. 8, an alternate embodiment of a plenum in accordance with the invention is illustrated and generally designated by the numeral 82. The plenum 82 may be a fabricated, generally square shaped totally enclosable structure comprising a substantially airtight collapsible bag formed of a suitably heavyweight elastomer or polymer material, such as fabric reinforced vinyl, for example. The plenum 82 includes side walls 82*a*, 82*b*, 82*c* and 82*d*, integral with each other at cooperating edges and integral with a bottom wall 83. A top wall 84 is integrally hinged to side wall 82*c* and is closable by a slide fastener closure 86 engageable with the top edges of side walls 82*a*, 82*b* and 82*d*. Each of side walls 82*a*, 82*b*, 82*c* and 82*d* is provided with a generally rectangular opening 85, as shown for side walls 82*a* and 82*b*. A generally cylindrical port 87 is formed in side wall 82*a* and is delimited by a cylindrical flange or collar 88 for attachment to a duct section, such as the duct section 36, if the plenum 82 is used in place of the plenum 38.

The plenum 82 may be held erect, regardless of any inflation pressure forces exerted thereon, by the discharge of pressure fluid into the interior of the plenum, by a suitable collapsible framework 89, comprising four diagonal telescoping rods, for example, three visible in FIG. 8, similar to conventional collapsible tent frames of known types. However, as shown in FIG. 8, the filter units 80 may be mounted on the inside surfaces of the walls 82*a*, 82*b*, 82*c* and 82*d* by fastener means 81 in the same manner that these filter units are mounted within the plenum 38. Accordingly, the plenum 82 may be substituted for the plenum 38 in the operation of a system in accordance with the invention, as illustrated in FIG. 1, whereby contaminated air, toxic or combustible vapors or gasses are being evacuated from an enclosed space by the system.

Figure 6:
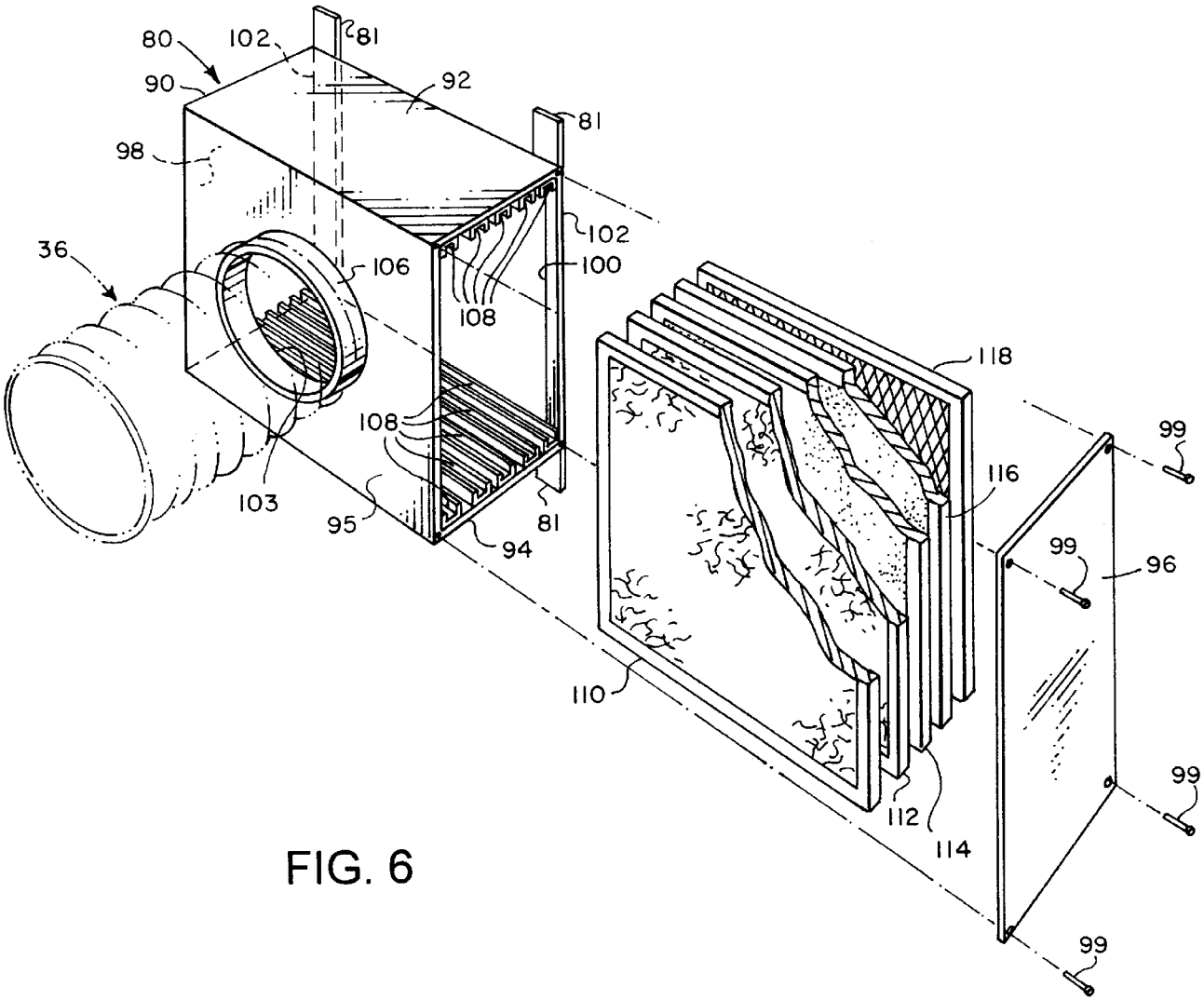
FIG. 6 is an exploded perspective view of a high capacity filter unit in accordance with the present invention.

Referring now to FIG. 6, one of the filter units 80 is shown in exploded perspective view. Each filter unit 80 is characterized by a generally rectangular lightweight aluminum or reinforced plastic housing 90 having opposed top and bottom walls 92 and 94, a back wall 95 and opposed end walls 96 and 98. End wall 98 is adapted to be removably connected to the remainder of the housing 90 by suitable fasteners 99. One side of the housing 90 is essentially open as indicated by the opening 100. However, suitable struts 102 interconnect top and bottom walls 92 and 94 to enhance the rigidity of the housing. A cylindrical port 103 is formed in back wall 95 of housing 90 and is delimited by a cylindrical collar 106. The diameter of collar 106 is dimensioned to provide for connecting a duct section, such as the duct section 36, directly to the filter unit 80. Alternatively, the port 103 may remain open to the interior of one of the plenums 38 or 82 when one or more of the filter units 80 are mounted within respective ones of the plenums. Still further, if a filter unit 80 is to be directly connected to a duct section 36 and the blower unit 28 operated at a throughput volumetric flow rate capacity which the filter unit 80 is capable of handling, the filter unit 80 may be connected directly to the duct section 36 and the filter unit may be mounted adjacent a window opening or the like for discharging gasses being evacuated by the system 10 directly out of doors after suitable filtration. The depth of housing 90 between wall 95 and opening 100 is preferably about twenty four inches.

Referring further to FIG. 6, the filter unit 80 comprises opposed sets of guide channel members 108 mounted on facing sides of the top and bottom walls 92 and 94 and aligned with each other to receive respective, generally rectangular filter panels 110, 112, 114, 116 and 118. The filter panels 110 and 112 may be of an impingement type for filtering particulates and utilizing a glass fiber mesh, for example. The filter panels 114 and 116 may be charcoal/carbon type filter panels, such as commercially available from Carbotron Corporation. Lastly, the filter panel 118 may be a fine mesh final filter. Accordingly, in a typical application involving the filtration of fine particulates, as well as gaseous volatile organic compounds or toxic gasses, the arrangement of filter panels shown in FIG. 6 may be used in the filter unit 80.

Alternatively, or in addition to the filter unit 80, at least one gas phase filter adapted to remove a wide range of airborne gaseous pollutants may be substituted for one or more of the panels 110 through 116. For example, FP gas phase type filters available from The Filtration Group, Joliet, Ill., are operable to remove various types of airborne contaminants utilizing twelve inch thick filters of either activated carbon or potassium permanganate filter media, a combination of both, or a chemisorbent to effectively remove volatile organic compounds, motor vehicle exhaust fumes, hydrogen sulfide, di-isocyanates and other aliphatic chemicals, ammonia, formaldehyde and a substantial variety of hydrocarbon based contaminants from contaminated air passing therethrough.

Figure 9:
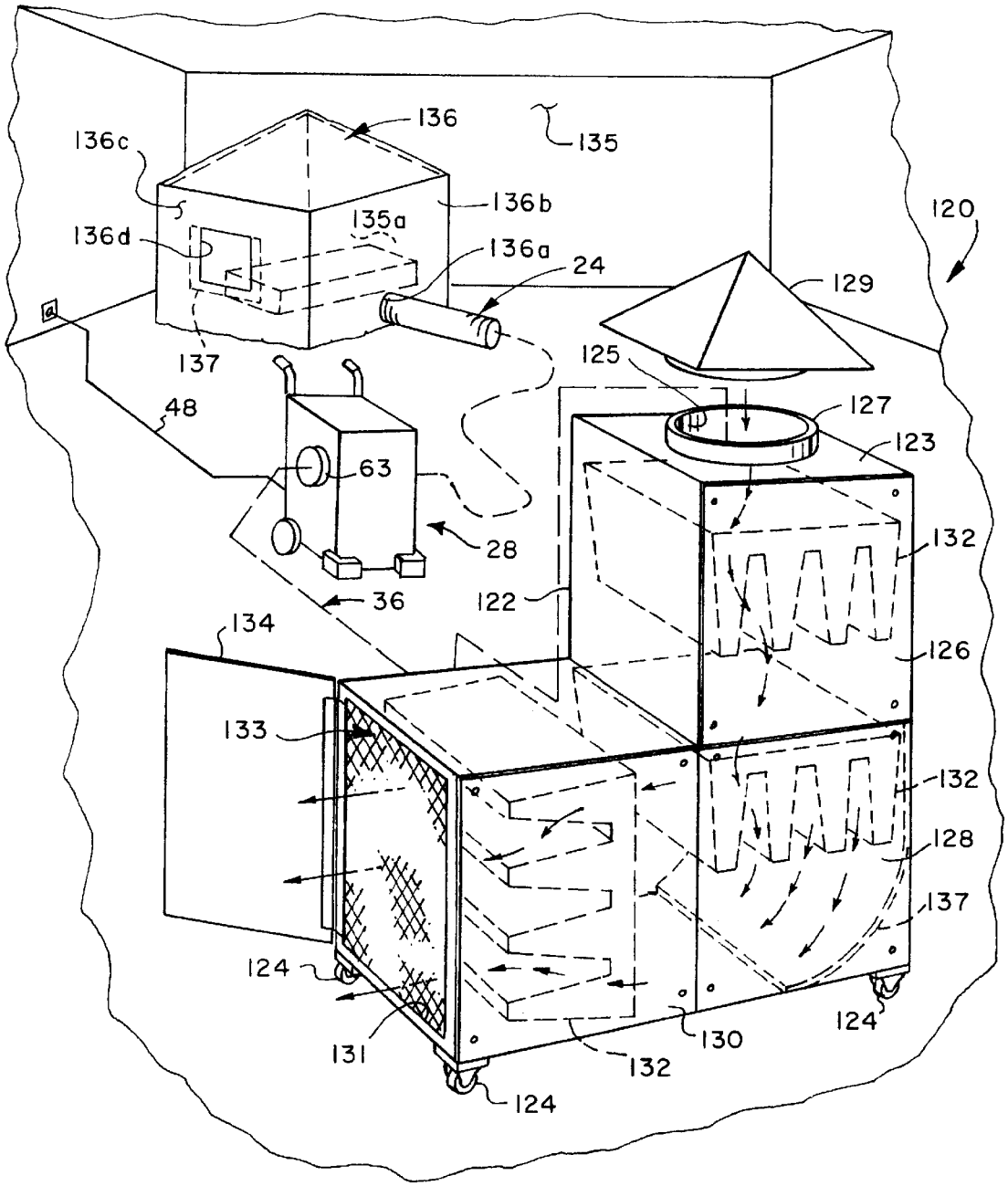
FIG. 9 is a perspective view of an alternate embodiment of a system in accordance with the invention and including another embodiment of a high volumetric flow rate capacity filter unit.

For certain applications where high concentrations of toxic, volatile or combustible gasses or vapors must be evacuated, a filter unit 120 may be provided, as shown in FIG. 9. The filter unit 120 comprises a cabinet 122 of a generally rectangular and backward "L" shaped configuration, as shown, and mounted on four spaced apart wheels or casters 124, three shown, of conventional construction. The cabinet 122 may be formed of eighteen gauge steel or aluminum sheet, for example, and is provided with removable side wall panels 126, 128 and 130 to provide access to three series arranged filter panels 132 which are of the compact minipleat type providing a substantially large filter surface area for the corresponding panel dimensions. The filter panels 132 may also be of the FP type available from The Filtration Group. The cabinet 122 includes a horizontal top wall 123 having an entry port 125 formed therein and delimited by a cylindrical flange 127 which may be directly connected to the downstream end of a duct section such as the end 36*b* of a duct section 36. A suitable removable weather cap 129 is operable to be placed over the flange 127 when the filter unit 120 is not in use.

The filter unit 120 includes a generally rectangular discharge port 131 disposed downstream of the third one of the series arranged filter panels 132 and having a fine metal mesh filter panel 133 disposed thereover. A hinged door 134 mounted on the housing 122 is operable to close over the port 131 when the filter unit 120 is not in use. As shown in FIG. 9, one or more suitable curved guide vanes 137, one shown, may be provided between the second and third stage filter panels 132.

Referring further to FIG. 9, the filter unit 120 is shown in use in an application wherein construction work is being carried out within an interior room 135 and more particularly within a space 135*a* delimited by a portable flexible partition member comprising an enclosure such as a tent 136, which has been erected over a work site. Tent 136 delimits space 135*a* and may be formed of a suitable substantially vapor impervious fabric, such as flexible polyvinylchloride and includes a suitable port 136*a* formed in a sidewall 136*b* thereof and operable to be connected to flexible duct section 24. Duct section 24 is connected to the blower unit 28 which, in turn, is also connected to duct section 36 leading to the inlet port 125 of filter unit 120. A second sidewall 136*c* of tent 136 may have a suitable opening 136*d* formed therein and over which a flap 137 is disposed to prevent volatile or toxic vapors from escaping from the space 135*a* interior of the partition or tent 136 but may allow the ingress of air from the space 135 into the space 135*a* within the interior of the tent to allow for makeup of air being evacuated from the tent by the blower unit 28.

Accordingly, in situations wherein, for example, workmen are using toxic or extremely flammable adhesives to build an interior structure within a confined space, such as the space 135, toxic or flammable vapors or gasses generated by such work, will not permeate interior spaces such as elevator shafts and stairwells or enter the building air conditioning system. Moreover, the filter units 132 may be of a type which include potassium/carbonate active ingredients to filter out aliphatic toxins and other chemicals before the air from within the confines of the tent 136 is released to the atmosphere of the interior of the building, such as the room 135.

Figure 7:
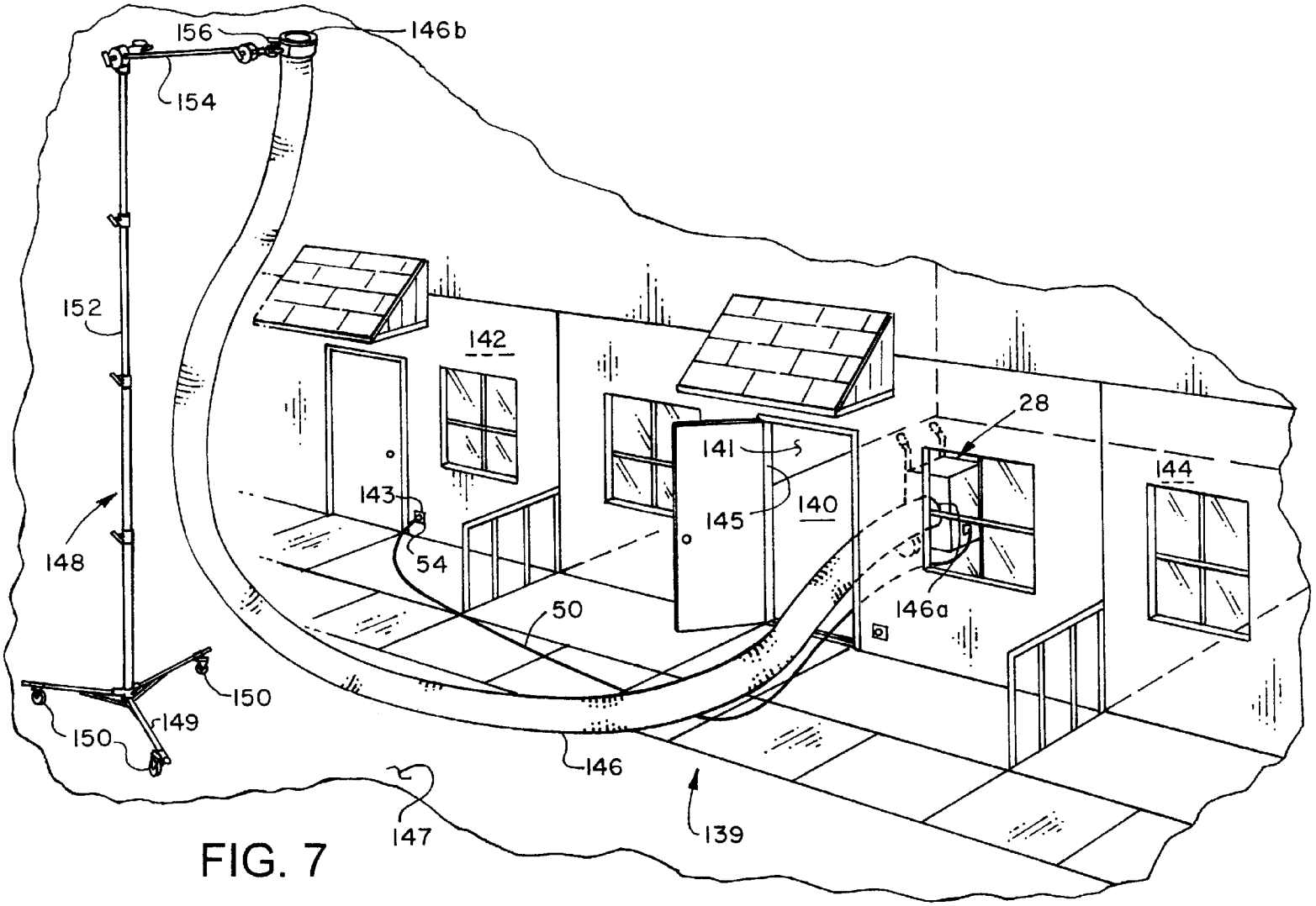

Referring now to FIG. 7, in certain instances it may be necessary or highly desirable to evacuate a high concentration of toxic or explosive fumes or gasses from an interior space in an emergency situation. For example, such action would be required in the event of a natural gas or liquefied petroleum gas leak into an interior space, such as an apartment or dwelling unit 140. In the illustrative example in FIG. 7, the apartment or dwelling unit 140 is arranged adjacent to other similar dwelling units 142 and 144. Assuming that the interior space 141 of apartment unit 140 has become substantially contaminated due to a natural gas leak, an environmental control system 139, including a blower unit 28 may be placed within the space 141 while the lengthy power cord 50 is connected to a suitable receptacle 143 a substantial distance away from the entry 145 to the space 141. An elongated duct section 146, similar to the duct section 36, but of substantially greater length, is preconnected at one end 146*a* to the discharge port of the blower unit 28 and arranged to have its discharge 146*b* disposed a substantial distance from the interior space 141 and in open atmosphere. Preferably the discharge end 146*b* of duct 146 is elevated above surface 147 a suitable distance, approximately fifteen to twenty feet, by a mechanism 148, as illustrated in FIG. 7.

The duct elevating mechanism 148 is highly portable and may be made up of component parts of a type commercially available. The mechanism 148 includes a base 149 preferably mounted on casters 150 and an upstanding telescoping tower part 152. Tower part 152 is connected to an elongated arm 154 which, in turn, is connected to a suitable support bracket 156 which is connected to the discharge end 146*b* of duct 146 by a suitable collar, also of a type commercially available. Mechanism 148 may be adapted from commercially available lighting grips of a type manufactured under the tradename AVENGER by Bogen Cine, Ramsey, N.J. For example, a type A300 or A302 high overhead stand lighting grip mechanism may be used together with a Model D520 extension grip arm and Model F810 swivel bracket for the components 154 and 156, respectively.

Accordingly, the system 139 shown in FIG. 7 and described above, may be easily stored on an emergency response vehicle and taken to the scene of a toxic or flammable gas leak in an interior space, such as the interior space 141. The blower unit 28 may be quickly placed within the space 141 with the duct 146 already connected thereto. The power cord 50 is extended to a point of connection of the plug 54 a substantial distance from the contaminated space 141 and the discharge end of the duct 146 is connected to the mechanism 148 and elevated a substantial distance above surface 147 so that discharge of flammable gas may be dissipated above ground level and out of range of a source of combustion at ground level. In this way, minimal exposure of emergency personnel to the confined and highly explosive interior space 141 may be obtained while the system 139 shown in FIG. 7 is placed in operation to evacuate the aforementioned gasses or vapors. Accordingly, thanks to the substantially non-explosive configuration of the blower unit 28 this unit may be placed in an interior space in an emergency situation to evacuate dangerous and combustible gasses without any concern or need to filter such gasses due to the emergency nature of the usage of the blower unit, the discharge duct 146 and the elevating mechanism 148.

As discussed hereinbefore, the present invention relates to portable filter units and blowers for removal of volatile organic compounds such as ignitable gasses. Other VOCs such as auto paints, resurfacing material, porcelain paints, reducers, bonding glues, acid fumes, water tower paints, grain combustion materials in silos, and petroleum fumes in empty freighter cargo holds or tanks are also removable by the systems of the invention.

Currently, there is no portable blower system for removal of ignitable fumes and particulate solids that can pull VOCs out of a potential combustion area at a fast enough flow rate to prohibit contamination or reduce quickly the concentration of explosive VOCs in a confined space.

Prior art blower systems available that can pull fumes at more than 800 CFM are currently direct driven motors rather than indirectly driven, meaning that the fumes and gasses travel directly through the motor. They are not hazardous condition motors and can ignite or clog up with entrained paint solids, for example.

Another concern to be addressed is the evacuation of toxic or volatile fumes. Currently, HEPA filters within direct drive ventilation systems greatly reduce the maximum CFM capacity of only 500 CFM. Furthermore, portable systems available are not really portable in that they cannot be moved by one fireman or utility technician up a flight of stairs to an upper floor apartment having a gas leak and a volatile atmospheric condition. Portability is a major concern because of the short timeframe that could endanger lives, or the equipment cannot be set up quickly in any location to dispense the high concentration of VOCs before the problem is contained.

Setup should include the capacity of the system to be plugged into a standard wall plug at a safe distance outside of the VOC area. Ventilation systems available that pull over a 1000 CFM use a 220 volt adapter commonly used for washers and dryers. Some apartments, shop decks, grain silos, homes, businesses and hotels are not conveniently supplied with 220 volt connectors. In a potentially explosive environment, the user of the ventilation equipment does not have the extra minutes to figure out if they have access to a 220 volt source anywhere in the vicinity. In the painting and resurfacing industry, porcelain enamels sprayed on hotel and apartment tubs, sinks and countertops are as explosive as auto paints. A hazardous conditions rated portable unit is needed that doesn't allow powder-like paint pigment to clog up its drive motor. While also it safely pulls out over spray through a spring flex neoprene duct and out of the resurfaced room into the open outside air or through a potassium/charcoal filter unit in a high rise enclosed building.

Currently, national laws do not require that resurfacing materials be contained in a filter box during removal, no more than in the paint booth of a car repair garage. Hazardous conditions exist with direct drive motors and fans used in stationary paint booth and chemical plant facilities. However, there is no lightweight, portable system available to move dangerous VOCs out of an atmosphere quickly and efficiently when there is no built-in system within the plant or building.

As it stands today, a hotel customer or apartment dweller can inhale dangerous chemicals from the unit above or below them being resurfaced due to open duct vents. There is not a system available with a hazardous conditions indirect driven motor to remove the paint spray and fine powder from a kitchen or bathroom in hotels or apartments.

Currently, tradesmen are using non-hazardous condition shop fans, and are plugging them into the wall in the same atmosphere as the VOCs. These systems remove chemical particulates at a maximum rate of 200–500 CFM max. This is not fast enough to remove particulates with too much reducer in the paint, for example.

Although preferred embodiments of a portable environmental control system and emergency gas evacuation system have been described in detail herein, those skilled in the art will recognize that the system may be constructed using materials and practices described above as well as known to those of skill in the same art. Still further, those skilled in the art will also appreciate that various substitutions and modifications may be made to the systems described without departing from the scope and spirit of the appended claims.

What is claimed is:

1. A portable environmental control system for evacuating toxic, particulate laden or explosive gasses from a space, said system comprising:

a first flexible duct section having one end disposed to evacuate said gasses from said space;

a motor driven blower unit including a housing, an inlet port in said housing, a discharge port in said housing, and a flow duct extending between said inlet and discharge ports, said inlet port being connected to an opposite end of said first duct section, said blower unit including a propulsion fan disposed to evacuate gasses from said space through said first duct section and through said flow duct in said housing;

a second flexible duct section connected at one end to said discharge port; and at least one filter unit connected to said second duct section at an end opposite the end connected to said discharge port for receiving gasses evacuated from said space and for treating said gasses to reduce hazards associated therewith.

2. The system set forth in claim 1 including:

a partition member disposed to delimit at least part of said space, said partition member including a port formed therein and connected to said one end of said first duct section.

3. The system set forth in claim 2 wherein:

said partition comprises a flexible cover for disposition in a doorway to said space, said cover having a collar delimiting said port and connected to said one end of said first duct section.

4. The system set forth in claim 2 wherein:

said partition comprises a tent-like structure having a collar delimiting said port and connected to said one end of said first duct section.

5. The system set forth in claim 1 wherein:

said propulsion fan is drivenly connected to a motor mounted in said housing of said blower unit by mechanical drive means, said motor and said mechanical drive means being isolated from contact with said gasses being evacuated from said space.

6. The system set forth in claim 1 wherein:

said blower unit includes support wheels thereon for moving said blower unit to and from a position at least adjacent said space.

7. The system set forth in claim 1 wherein:

said motor is electric powered and said blower unit includes conductor connections means for said motor including an explosion-proof junction box, and a high voltage power cord connectable to said blower unit at said junction box.

8. The system set forth in claim 7 including:

cord storage means mounted on said housing of said blower unit.

9. The system set forth in claim 7 including:

a second power cord operably connected at one end to said housing for connecting said motor to a source of low voltage electric power.

10. The system set forth in claim 1 wherein:

said housing of said blower unit is formed of a substantially non-sparking material and said housing includes force absorbing means formed thereon for minimizing damage to objects in a space in which said blower unit is moved and to minimize spark generating contact between said housing and an object within or adjacent said space.

11. The system set forth in claim 1 wherein:

said filter unit includes at least one filter housing, at least one filter panel disposed in said filter housing for extracting particulates conducted through said first duct section, said blower unit and said second duct section to said filter unit, and at least one filter panel for extracting toxic and/or combustible gasses being evacuated from said space.

12. The system set forth in claim 1 wherein:

said filter unit includes a portable plenum, a port for connecting said second duct section to said plenum and a plurality of filter units mounted in the interior of said plenum for receiving gasses evacuated from said space and for discharging gasses substantially void of particulates and/or toxic or combustible gasses from said plenum into an interior room adjacent said space.

13. The system set forth in claim 12 wherein:

said plenum includes opposed side walls for supporting plural filter units, respectively, for discharging air treated by said filter units into an interior room adjacent said space.

14. The system set forth in claim 12 wherein:

said plenum is collapsible.

15. The system set forth in claim 12 wherein:

said plenum is formed of a flexible bag having a top wall, a bottom wall and four side walls integrally joined and adapted to receive plural ones of said filter units therewithin.

16. The system set forth in claim 12 wherein:

each of said filter units in said plenum include a filter housing, an inlet port formed in said housing and a discharge opening formed in said housing and plural filter panels mounted in said housing for extracting particulates, toxic and combustible gasses being evacuated from said space.

17. The system set forth in claim 16 wherein:

said port in said housing of said filter unit is operable to be connected to said second duct section directly for receiving gasses evacuated from said space by way of said blower unit.

18. The system set forth in claim 1 wherein:

said one filter unit comprises a cabinet, a plurality of filter panels mounted in said cabinet in series arrangement for receiving gasses evacuated from said space and for discharging air from said cabinet after treatment thereof to remove said gasses by said filter panels.

19. The system set forth in claim 18 wherein:

said cabinet is mounted on plural wheels for moving said cabinet at will within an area adjacent said space.

20. A portable environmental control system for evacuating toxic, particulate laden or explosive gasses from a space, said system comprising:

a flexible partition member disposed to delimit at least part of said space, said partition member including a port formed therein;

a first flexible duct section connected to said partition member at said port at one end of said first duct section;

a motor driven blower unit including a housing formed of a substantially non-sparking material, an inlet port in said housing, a discharge port in said housing, and a flow duct extending between said inlet and discharge ports, said inlet port being connected to said first duct section, said blower unit including a propulsion fan drivenly connected to an electric motor mounted in said housing of said blower unit by mechanical drive means, said motor and said mechanical drive means being isolated from contact with said gasses being evacuated from said space, said propulsion fan being disposed to evacuate gasses from said space through said first duct section and through said flow duct in said housing, conductor connections means for said motor including an explosion-proof junction box, and a power cord connectable to said blower unit at said junction box for connecting said blower unit to a source of electric power;

a second flexible duct section connected at one end to said discharge port;

a portable plenum including a port for connecting said second duct section to said plenum; and a plurality of filter units mounted in said plenum for receiving gasses evacuated from said space and for discharging air substantially void of particulates and/or toxic or explosive gasses from said plenum.

21. The system set forth in claim 20 wherein:

said blower unit includes support wheels thereon for moving said blower unit to and from a position at least adjacent said space.

22. The system set forth in claim 20 including:

cord storage means mounted on said housing of said blower unit.

23. The system set forth in claim 20 including:

a second power cord operably connected at one end to said housing for connecting said motor to another source of electric power.

24. The system set forth in claim 20 wherein:

said filter units each include at least one filter housing, at least one filter panel disposed in said filter housing for extracting particulates conducted through said first duct section, said blower unit and said second duct section to said filter unit, and at least one filter panel for extracting toxic and/or explosive gasses being evacuated from said space.

25. The system set forth in claim 20 including:

said plenum is formed of a flexible bag having a top wall, a bottom wall and side walls integrally joined and adapted to receive plural ones of said filter units therewithin.

* * * * *